US012168552B2

(12) United States Patent
Hui et al.

(10) Patent No.: US 12,168,552 B2
(45) Date of Patent: Dec. 17, 2024

(54) PACKAGING FOR AN INPUT DEVICE

(71) Applicant: Logitech Europe S.A., Lausanne (CH)

(72) Inventors: Ka Sin Hui, Hong Kong (CN); Andrew Chuang, Hsinchu (TW); Shaoquan Li, Zhongshan (CN); Yen Ning Chu, Taoyuan (TW); Ching Man Lam, Honk Kong (CN)

(73) Assignee: Logitech Europe S.A., Lausanne (CH)

( * ) Notice: Subject to any disclaimer, the term of this patent is extended or adjusted under 35 U.S.C. 154(b) by 12 days.

(21) Appl. No.: 18/046,771

(22) Filed: Oct. 14, 2022

(65) Prior Publication Data

US 2023/0382592 A1 Nov. 30, 2023

Related U.S. Application Data

(63) Continuation of application No. PCT/CN2022/096187, filed on May 31, 2022.

(51) Int. Cl.

| | |
|---|---|
| ***B65D 5/50*** | (2006.01) |
| ***B65D 5/42*** | (2006.01) |
| ***B65D 25/10*** | (2006.01) |

(52) U.S. Cl.

CPC ..... *B65D 5/5035* (2013.01); *B65D 25/10* (2013.01); *B65D 5/4237* (2013.01)

(58) Field of Classification Search

CPC ..... B65D 2585/6837; B65D 2585/00; B65D 5/5035; B65D 5/5213; B65D 81/05

(Continued)

(56) References Cited

U.S. PATENT DOCUMENTS 2,868,364 A * 1/1959 Helser ..... G09F 1/04 D19/91
4,164,312 A * 8/1979 Harned ..... B65D 5/48048 206/448

(Continued)

FOREIGN PATENT DOCUMENTS

CN 205998310 U 3/2017
CN 206797993 U 12/2017

(Continued)

OTHER PUBLICATIONS

International Search Report and Written Opinion for Application No. PCT/CN2022/096187, Mailed on Dec. 19, 2022, 8 pages.

*Primary Examiner* — Steven A. Reynolds
*Assistant Examiner* — Prince Pal
(74) *Attorney, Agent, or Firm* — Kilpatrick Townsend & Stockton LLP

(57) ABSTRACT

A package for a computer peripheral device includes a box having a bottom surface and sidewalls that define a cavity. A peripheral insert is positionable within the cavity. The insert includes a back portion coupled with a rear sidewall of the box. A base portion extends at an angle from a bottom edge of the back surface. A rear section and a front section of the base portion are pivotally coupled. The back portion and rear section define a tab. The insert is movable between stowed and access configurations by applying a force on the tab. In the stowed configuration, the base portion is seated against the bottom surface and the back portion is substantially parallel to the rear sidewall. In the access configuration, the rear and front sections are tented and the back portion of the insert is pulled away from and angled relative to the rear sidewall.

12 Claims, 12 Drawing Sheets

(58) Field of Classification Search
USPC ..... 220/528, 529; 211/184; 206/561
See application file for complete search history.

(56) References Cited

U.S. PATENT DOCUMENTS 4,225,038 A * 9/1980 Egly ..... G11B 33/0433 206/472
4,508,217 A * 4/1985 Long ..... B42F 7/14 206/472
4,602,715 A * 7/1986 Sarver ..... B65D 25/06 206/561
4,801,004 A * 1/1989 Egly ..... G11B 33/0433
5,056,665 A * 10/1991 Boecker ..... B65D 81/07 206/583
5,121,838 A * 6/1992 Dickie ..... B65D 5/5021 206/707
5,163,547 A * 11/1992 Hsieh ..... B44D 3/00 220/532
5,165,649 A * 11/1992 Neumann ..... A47B 23/044 248/459
5,214,574 A * 5/1993 Chang ..... G06F 1/1628 D3/276
5,445,266 A * 8/1995 Prete ..... G06F 1/1628 190/102
5,529,174 A * 6/1996 McQueeny ..... B65D 5/5035 206/774
5,553,444 A * 9/1996 Lovecky ..... B65D 81/07 53/472
5,636,746 A * 6/1997 McQueeny ..... B65D 5/64 206/769
5,791,468 A * 8/1998 House ..... G11B 33/0405
5,803,267 A 9/1998 Tu et al.
5,871,094 A * 2/1999 Leibowitz ..... A45C 13/28 206/320
6,073,794 A * 6/2000 Bidot ..... A47B 88/975 312/348.3
6,142,304 A * 11/2000 Moren ..... B65D 81/133 206/592
6,401,942 B1 * 6/2002 Eckert ..... A47F 1/126 211/59.3
6,490,154 B2 * 12/2002 Thompson ..... G06F 1/1632 361/679.41
7,140,499 B2 * 11/2006 Burke ..... A47F 1/126 211/59.3
7,163,119 B2 * 1/2007 Besselman ..... A47B 96/04 220/551
7,278,249 B2 * 10/2007 Kari ..... B65D 5/5069 493/137
7,324,333 B2 * 1/2008 Allen ..... E05B 73/0082 361/679.55
7,735,644 B2 * 6/2010 Sirichai ..... A45C 11/00 206/45.24
7,810,639 B2 * 10/2010 Djulaini ..... B65D 81/113 206/307
8,132,670 B1 * 3/2012 Chen ..... A45C 11/00 206/45.24
8,763,795 B1 * 7/2014 Oten ..... B65D 85/00 206/45.24
9,095,194 B2 * 8/2015 Hassett ..... G06F 1/1626
10,389,398 B1 * 8/2019 Garcia ..... A45C 3/02
10,687,624 B2 * 6/2020 Conrad ..... A47F 5/112
11,076,665 B1 * 8/2021 Greene ..... B65D 5/52
2001/0020595 A1 * 9/2001 Koike ..... B65D 81/025 206/592
2002/0121521 A1 * 9/2002 Beal ..... B65D 77/0446 220/529
2003/0019779 A1 * 1/2003 Horbal ..... B65B 5/024 206/521
2003/0234207 A1 * 12/2003 Koike ..... B65D 5/4204 53/472
2005/0284791 A1 * 12/2005 Sadow ..... B65D 81/052 206/320
2006/0110573 A1 * 5/2006 Peng ..... B65D 81/05 428/121
2009/0140031 A1 * 6/2009 Wang ..... B65D 5/5035 229/117.01
2009/0314826 A1 * 12/2009 Lee ..... B65B 23/00 53/472
2011/0290796 A1 * 12/2011 Burgess ..... B65D 21/04 220/552
2012/0043249 A1 * 2/2012 Tsukii ..... B65D 81/05 206/521
2015/0060310 A1 * 3/2015 Tseng ..... B65D 5/5213 206/45.23
2015/0114880 A1 * 4/2015 Hough ..... A45C 11/00 206/755
2015/0157105 A1 * 6/2015 Goodman ..... A45C 13/1076 206/6.1
2015/0203242 A1 * 7/2015 Magnusson ..... B65D 5/38 220/500
2015/0307246 A1 * 10/2015 Patwardhan ..... B65D 77/0433 206/1.5
2015/0329241 A1 * 11/2015 Lepage ..... B65D 25/108 206/316.2
2015/0375893 A1 * 12/2015 Korinek ..... B29C 51/264 493/90
2016/0001953 A1 * 1/2016 Chesworth ..... B65D 5/509 229/103.2
2016/0031626 A1 * 2/2016 Chan ..... B65D 5/505 493/63
2016/0101899 A1 * 4/2016 Weidner ..... G16H 40/20 53/473
2017/0341805 A1 * 11/2017 Al-Khal ..... B65D 5/54
2018/0072086 A1 * 3/2018 Mayer ..... B42D 15/045
2019/0168908 A1 * 6/2019 Lee ..... B65D 5/5021
2020/0231329 A1 * 7/2020 Cline ..... B65D 5/5066
2021/0002019 A1 * 1/2021 Rodrigues ..... B65D 5/422
2022/0234782 A1 * 7/2022 Uyeda ..... B65D 5/36
2023/0093285 A1 * 3/2023 Lee ..... B65D 5/6626 229/109
2023/0391515 A1 * 12/2023 Ye ..... B65D 5/5213
2024/0083654 A1 * 3/2024 Comerford ..... B65D 5/64

FOREIGN PATENT DOCUMENTS

CN 208412414 U 1/2019
CN 111498239 A 8/2020
CN 216270985 U 4/2022

* cited by examiner

PACKAGING FOR AN INPUT DEVICE

CROSS REFERENCE PARAGRAPH FOR PRIORITY

This application is bypass continuation of PCT Application No. PCT/CN2022/096187, filed on May 31, 2022, and titled "PACKAGING FOR AN INPUT DEVICE," which is hereby incorporated by reference in its entirety for all purposes.

BACKGROUND OF THE INVENTION

Computer peripheral devices often come in packaging that includes single-use plastics and/or other unsustainable materials. These materials may be formed into bags, shells, and/or other containers and/or padding that may help protect the computer peripheral device during transport and/or storage. However, such materials increase waste products that have a negative impact on the environment. To help combat some of this waste, some packaging is designed to better match the size of the peripheral device stored therein, however due to the size matching it may be difficult to remove the peripheral device from such packaging. Therefore, improvements in packaging for computer peripheral devices are desired.

BRIEF SUMMARY OF THE INVENTION

Embodiments of the present invention may include packages for a computer peripheral device. The packages may include an outer box having a bottom surface and a plurality of sidewalls that define an interior cavity. The packages may include a peripheral insert that is positionable within the interior cavity. The peripheral insert may include a back portion that is coupled with a rear sidewall of the plurality of sidewalls of the outer box. The peripheral insert may include a base portion that extends at an angle from a bottom edge of the back portion. The base portion may include a rear section and a front section that are pivotally coupled with one another. The back portion and the rear section of the base portion may define a tab. The peripheral insert may be movable between a stowed configuration and an access configuration by applying a pulling force on the tab. In the stowed configuration, the base portion of the peripheral insert may be seated against the bottom surface of the outer box and the back portion of the peripheral insert may be substantially parallel to the rear sidewall of the outer box. In the access configuration, the rear section and the front section of the base portion may be tented relative to one another.

In some embodiments, an upper surface of the rear section may be lower than an upper surface of the front section such that a recess is formed between the back portion and the front section. At least a portion of the back portion may be secured with the rear sidewall of the outer box using one or more coupling features. The one or more coupling features may include a slot formed in one of the back portion and the rear sidewall and a corresponding connector tab formed in the other one of the back portion and the rear sidewall. The connector tab may be engageable within the slot to secure the back portion with the rear sidewall of the outer box. The back portion may include two opposing walls that are coupled with one another and that extend over a portion of the rear sidewall of the outer box. The tab may be defined in both opposing walls such that when the back portion of the peripheral insert is positioned over the portion of the rear sidewall of the outer box, a distal end of the tab protrudes beyond a joint coupling the opposing walls. The front section of the base portion may include flaps that extend at angle from peripheral edges of the front section. One of the plurality of sidewalls of the outer box may define a recess that is sized and shaped to receive a connection mechanism of a peripheral device. When the rear section and the front section of the base portion are tented relative to one another, upper surfaces of each of the rear section and the front section may be angled upwards toward a center of the interior cavity. The front section of the base portion may define a slit that is sized to receive a user manual such that when the peripheral insert is in the access configuration the user manual is angled upward relative to the bottom surface of the outer box at a greater angle than when the peripheral insert is in the stowed configuration. In the access configuration at least a part of the back portion of the peripheral insert may be pulled away from and angled relative to the rear sidewall of the outer box.

Some embodiments of the present invention may encompass methods for unloading a computer peripheral device from a package. The methods may include receiving the package in a stowed configuration. The package may include an outer box having a bottom surface and a plurality of sidewalls that define an interior cavity. The package may include a peripheral insert that is positioned within the interior cavity. The peripheral insert may include a back portion that is coupled with a rear sidewall of the plurality of sidewalls of the outer box. The peripheral insert may include a base portion that extends at an angle from a bottom edge of the back surface. The base portion may include a rear section and a front section that are pivotally coupled with one another. The back portion and the rear section of the base portion may define a tab. In the stowed configuration, the base portion of the peripheral insert may be seated against the bottom surface of the outer box and the back portion of the peripheral insert may be substantially parallel to the rear sidewall of the outer box. The methods may include receiving a pulling force on the tab to transition the package from the stowed configuration to an access configuration in which the rear section and the front section of the base portion are tented relative to one another and at least a part of the back portion of the peripheral insert is pulled away from and angled relative to the rear sidewall of the outer box.

In some embodiments, the back portion may include two opposing walls that are coupled with one another and that extend over a portion of the rear sidewall of the outer box. Transitioning the package from the stowed configuration to the access configuration may include pulling the a front wall of the opposing walls away from a rear wall of the opposing walls. A portion of the rear wall may be fixedly coupled with the rear sidewall of the plurality of sidewalls of the outer box using a slot and connector tab connection. A distal end of the tab may be folded toward a center of the interior cavity such that the distal end of the tab extends over the computer peripheral device disposed within the interior cavity. Transitioning the package from the stowed configuration to the access configuration may cause the computer peripheral device disposed within the interior cavity to be elevated within the interior cavity such that at least a portion of the computer peripheral device extends above a top edge of the plurality of sidewalls of the outer box.

Some embodiments of the present invention may encompass package inserts for a computer peripheral device. The package inserts may include a back portion having at least one wall. The package inserts may include a base portion that is coupled to a bottom edge of the back portion, extending at an angle relative to the back portion. The base portion may include a rear section and a front section that are pivotally coupled with one another. The rear section and the front section may be moveable between a stowed configuration in which bottom surfaces of the rear section and the front section are at a first angle relative to one another and an access configuration in which bottom surfaces of the rear section and the front section are at a second angle relative to one another. The first angle may be different than the second angle. The back portion and the rear section of the base portion may define a tab.

In some embodiments, in the access configuration, the rear section and the front section may be tented relative to one another. The back portion may define one or both of a slot and a connector tab. A distal end of the tab may extend laterally away from the back portion.

BRIEF DESCRIPTION OF THE DRAWINGS

A further understanding of the nature and advantages of the disclosed technology may be realized by reference to the remaining portions of the specification and the drawings.

Figure 1A:
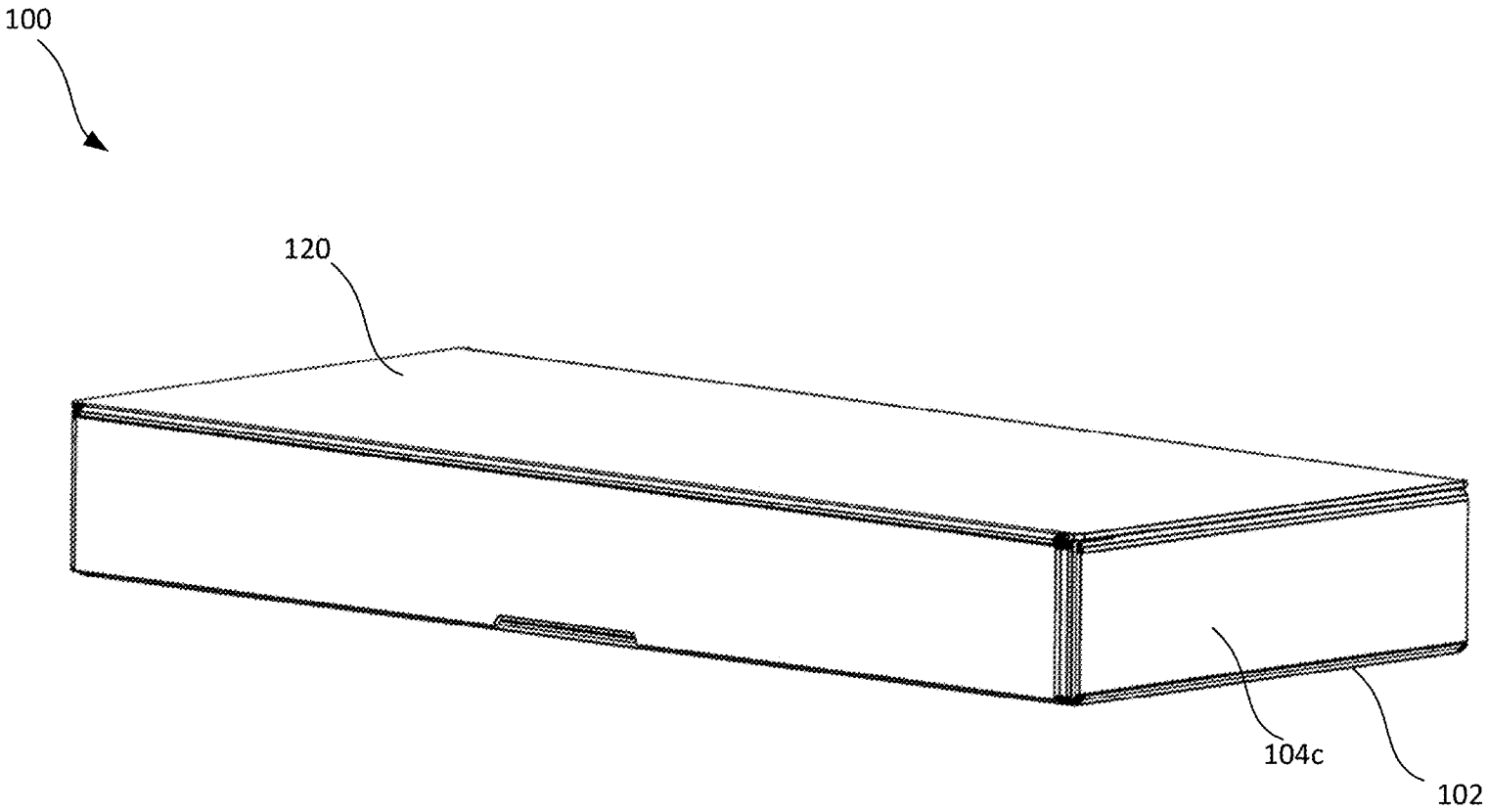
FIG. 1A is an isometric view of an outer box of a computer peripheral device package according to embodiments of the present invention.

Several of the figures are included as schematics. It is to be understood that the figures are for illustrative purposes, and are not to be considered of scale unless specifically stated to be of scale. Additionally, as schematics, the figures are provided to aid comprehension and may not include all aspects or information compared to realistic representations, and may include exaggerated material for illustrative purposes.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention are directed to packages for computer peripheral devices that are produced using sustainable materials. Additionally, embodiments may provide packages that include features that enable the computer peripheral device stored therein to be more easily removed, without the use of any additional tools or other objects. In particular, embodiments may include peripheral inserts that are positionable within an outer box and that are moveable between a stowed configuration and an access configuration. In the stowed configuration, the insert may be shaped such that the computer peripheral device may be fully disposed within an interior cavity defined by the outer box. In such a configuration, the outer box may be closed, such as by positioning a lid or other cover over the interior cavity. The peripheral insert may be moved to the access configuration, which may cause a portion of the peripheral insert to tent and/or otherwise protrude upward to lift the computer peripheral device at least partially out of the interior cavity to present the computer peripheral device to the user. This may provide the user with space to position one or more fingers behind the computer peripheral device to lift the computer peripheral device out of the interior cavity of the outer box. Actuation of the peripheral insert may be performed by applying a pulling force to a tab defined in and/or otherwise coupled with the peripheral insert.

In some embodiments, the entire peripheral insert may be formed from a single piece of a sustainable material, such as (but not limited to) cardboard. For example, a sheet of cardboard may be stamped and/or otherwise cut into a necessary shape and then folded to form the final peripheral insert. Such a design may simplify manufacturing and may further improve the sustainability of the package. While discussed primarily in the context of computer peripheral devices (such as keyboards, computer mice, etc.) it will be appreciated that the packaging techniques described herein are not so limited, and may be utilized in any other application in which more sustainable packaging solutions are desirable.

Figure 1B:
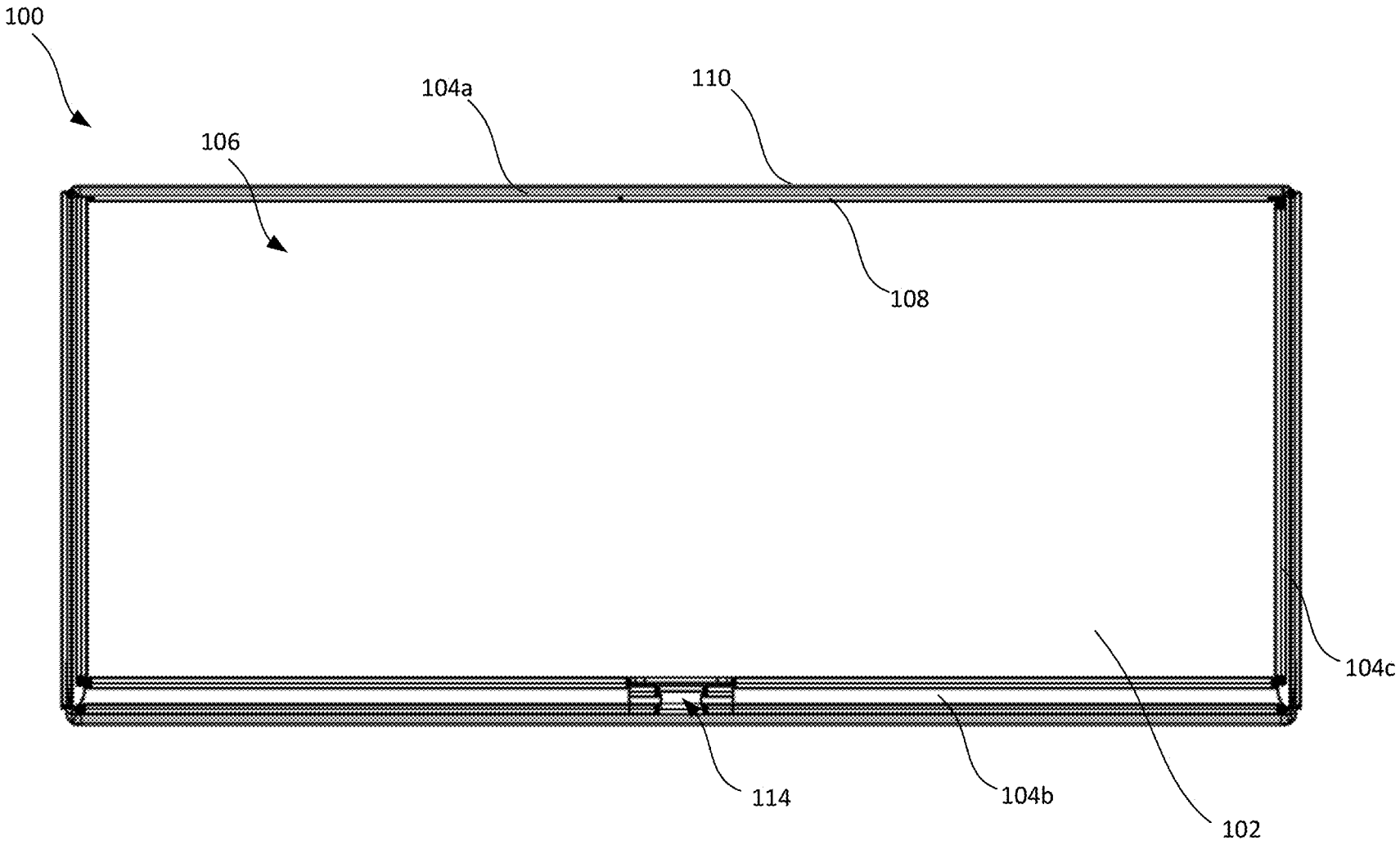
FIG. 1B is a partial cross-sectional top plan view of the outer box of FIG. 1A.

Turning now to FIGS. 1A-1D, an embodiment of an outer box 100 is illustrated. Outer box 100 may be used as a portion of a package for a computer peripheral insert as will be described in greater detail below. In some embodiments, outer box 100 may have a generally rectangular prism shape, although other shapes are possible in various embodiments. As best illustrated in FIG. 1B, outer box 100 may include a bottom surface 102 an one or more sidewalls that extend upward from the bottom surface 102. The sidewalls 104 may each be formed from one or more layers of material. In some embodiments, the bottom surface 102 and sidewalls 104 may be formed of one or more pieces of material that have been folded and secured to form the structure of the outer box 100. The material of the outer box 100 may be secured using adhesives and/or mechanical couplings, such as slots and tab connections, slits and/or other engagement features formed in one or more regions of the material. Where the outer box 100 has a rectangular prism shape, the outer box 100 may include four sidewalls 104 that extend about a periphery of the bottom surface 102. Together with the bottom surface 102, the sidewalls 104 define an interior cavity 106 that may be sized and shaped to receive a computer peripheral device (not shown). Computer peripheral devices may include, without limitation, keyboards, computer mice, webcams, speakers, monitors, and/or other devices that may be physically and/or communicatively coupled with a computing device.

Figure 1C:
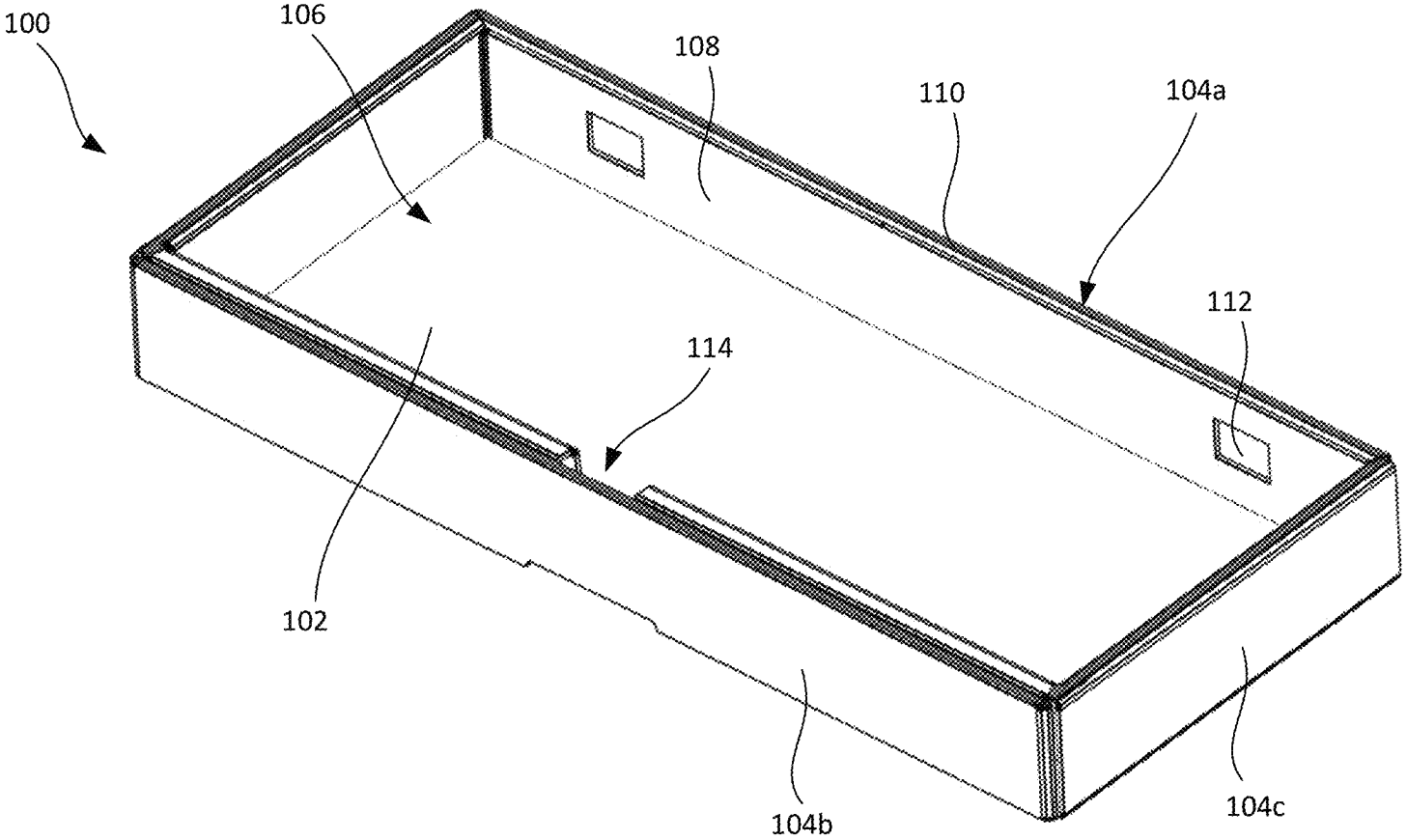
FIG. 1C is a partial cross-sectional isometric view of the outer box of FIG. 1A.

In some embodiments, one or more of the sidewalls 104 may be used to secure a peripheral insert (such as peripheral insert 200 described in relation to FIGS. 2A-2F below) within the outer box 100. As illustrated, a rear sidewall 104*a* of the outer box 100 may include an inner layer 108 and an outer layer 110 that are substantially parallel to one another. In some embodiments, the inner layer 108 of the rear sidewall 104*a* may be at least substantially continuous and may contain no features that interfere with a visibly smooth appearance and/or relatively smooth tactile feel. In other embodiments, the inner layer 108 may include one or more features that may be used to secure a peripheral insert within the outer box 100. For example, the inner layer 108 may define one or more slots 112, slits, connector tabs, and/or other features that may be used to secure the peripheral insert against the rear sidewall 104*a*. As best illustrated in FIG. 1C, two slots 112 are defined in the inner layer 108 and are spaced apart from one another along a length of the rear sidewall 104*a*. While two slots 112 are shown, it will be appreciated that any number of slots 112 and/or other securing features may be formed in the rear sidewall 104*a*. For example, the rear sidewall 104*a* may define and/or include at least one securing feature, at least two securing features, at least three securing features, at least four securing features, at least five securing features, or more. The securing features may be formed at any height and/or lateral position about the rear sidewall 104*a*. While illustrated and described as being formed in and/or otherwise included as part of a rear sidewall 104*a*, it will be appreciated that the structure of the rear sidewall 104*a* described herein may be incorporated into any one or more of the sidewalls 104 in various embodiments.

Figure 1D:
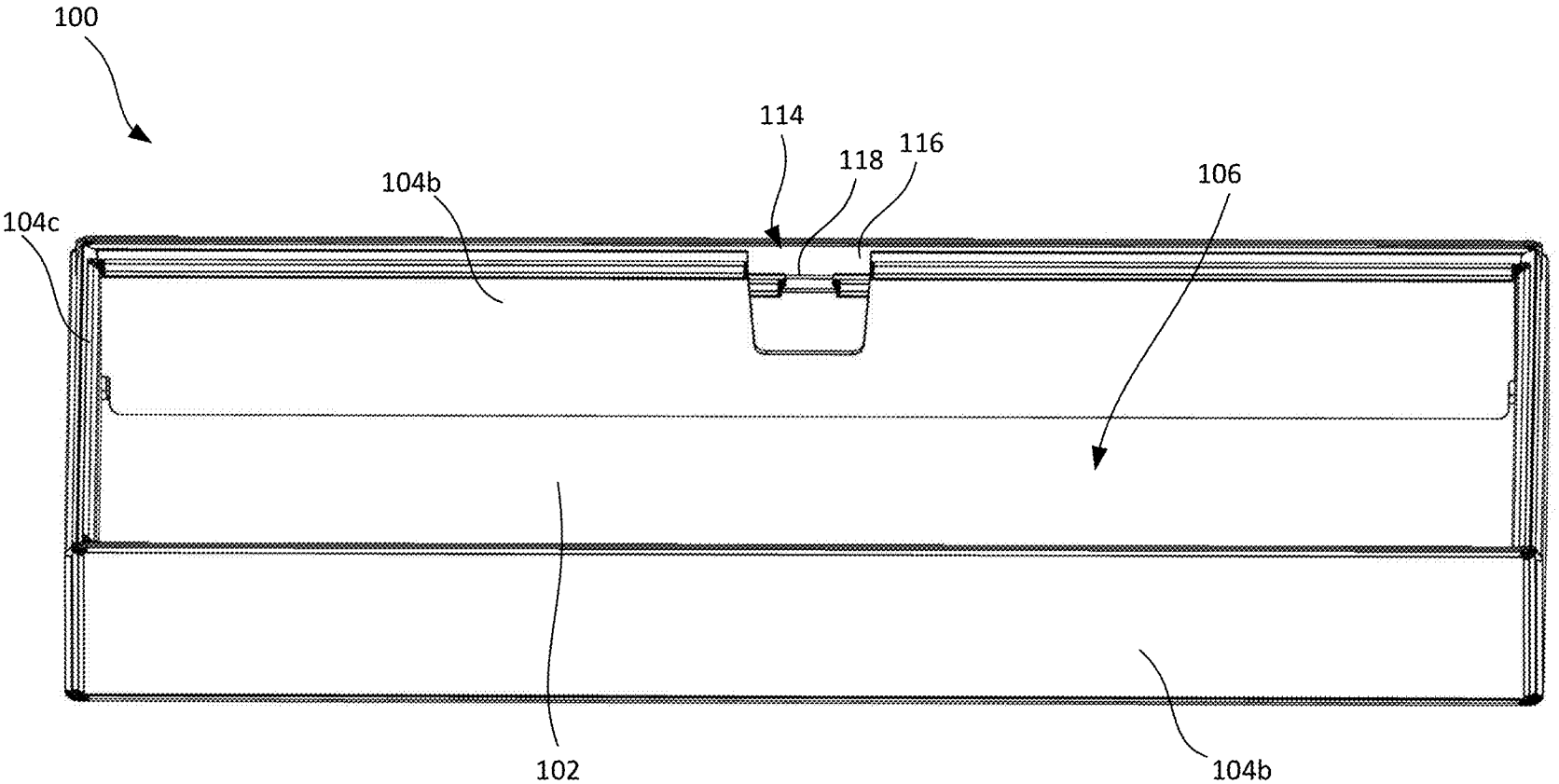
FIG. 1D is a partial cross-sectional rear perspective view of the outer box of FIG. 1A.

In some embodiments, one or more of the sidewalls 104 may define one or more storage features that may receive one or more components of the computer peripheral device. For example, as best illustrated in FIG. 1D, a front sidewall 104*b* may define a recess 114 that is sized and shaped to receive a connection mechanism of a peripheral device. In a particular embodiment, the recess 114 may be sized and shaped to receive a universal serial bus (USB) dongle and/or other connector for the peripheral device. For example, the recess 114 may include an upper region 116 and a lower region 118. In some embodiments, the upper region may be wider than the lower region 118. For example, the lower region 118 may be sized to securely receive (e.g., a friction fit) a USB connector of the dongle, while the upper region 116 may be sized to receive a housing of the dongle that may be graspable by a user when the dongle is engaged with a port of a computer device (or within lower region 118). A depth of each region of the recess 114 may be sufficient such that when the dongle or other connector is received within the recess 114, a top of the connector is disposed at or below a top edge of the sidewalls 104.

The outer box 100 may include a cover 120. In some embodiments, the cover 120 may be formed integrally with one or more of the sidewalls 104. For example, as illustrated in FIG. 1A cover 120 extends from a top edge of the rear sidewall 104*a* and may be pivoted over the interior cavity 106. The cover 120 may include a closure flap 122 that may fold over the front sidewall 104*b*, where one or more closure inserts (not shown) may be inserted into slots (not shown) formed in the lateral sidewalls 104*c* to secure the cover 120 in a closed position. It will be appreciated that the cover 120 may include other closure mechanisms in various embodiments. In some embodiments, the cover 120 may be fully separable from the bottom surface 102 and sidewalls 104. For example, the cover may include a top surface and a number of sidewalls. The sidewalls of the cover may define an open interior that is sized to receive the sidewalls 104, such that the cover may receive the sidewalls 104 to enclose the interior cavity and items stored therein.

Figure 2A:
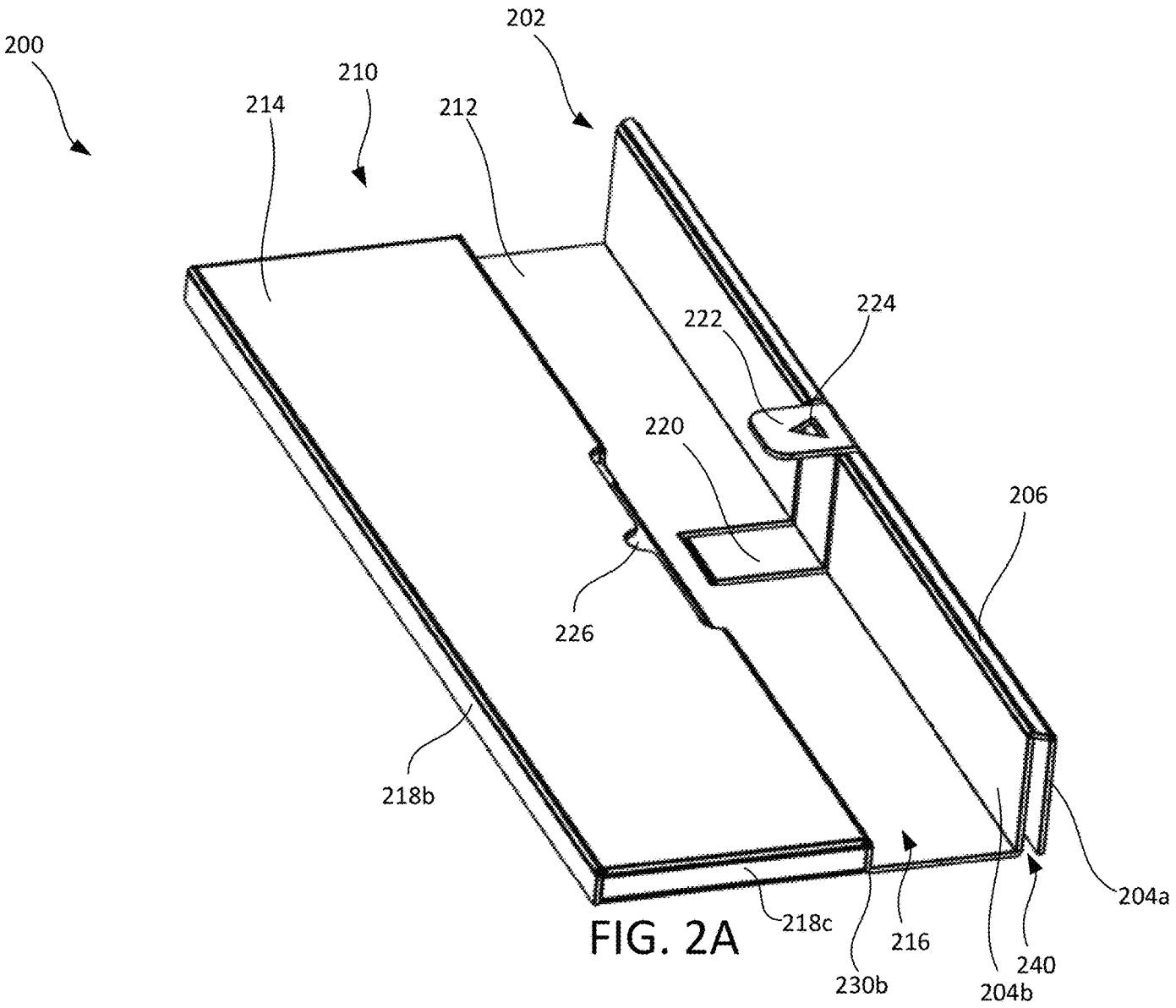
FIG. 2A is an isometric view of a peripheral insert of a computer peripheral device package according to embodiments of the present invention.
Figure 2B:
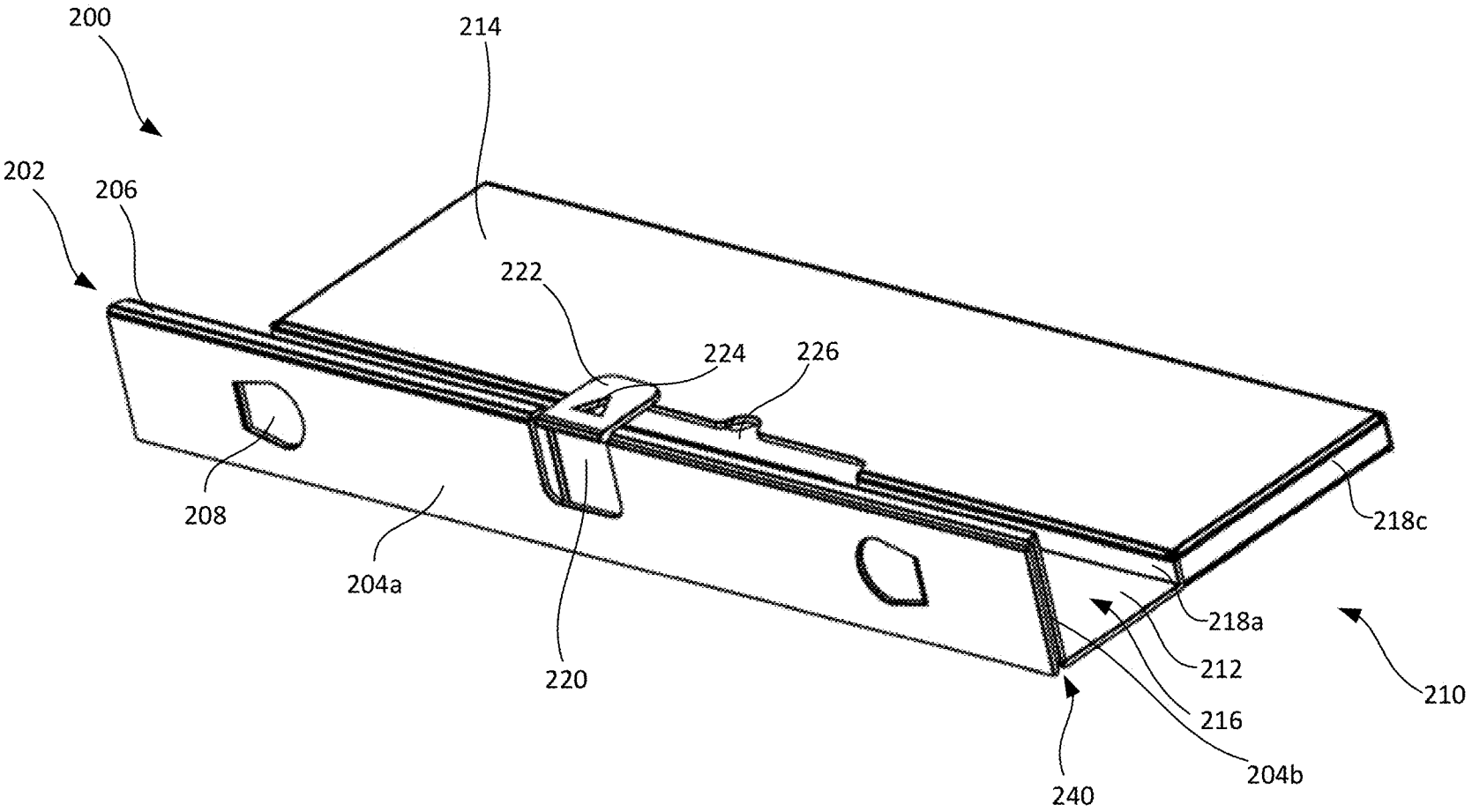
FIG. 2B is a rear perspective view of the peripheral insert of FIG. 2A.
Figure 2C:
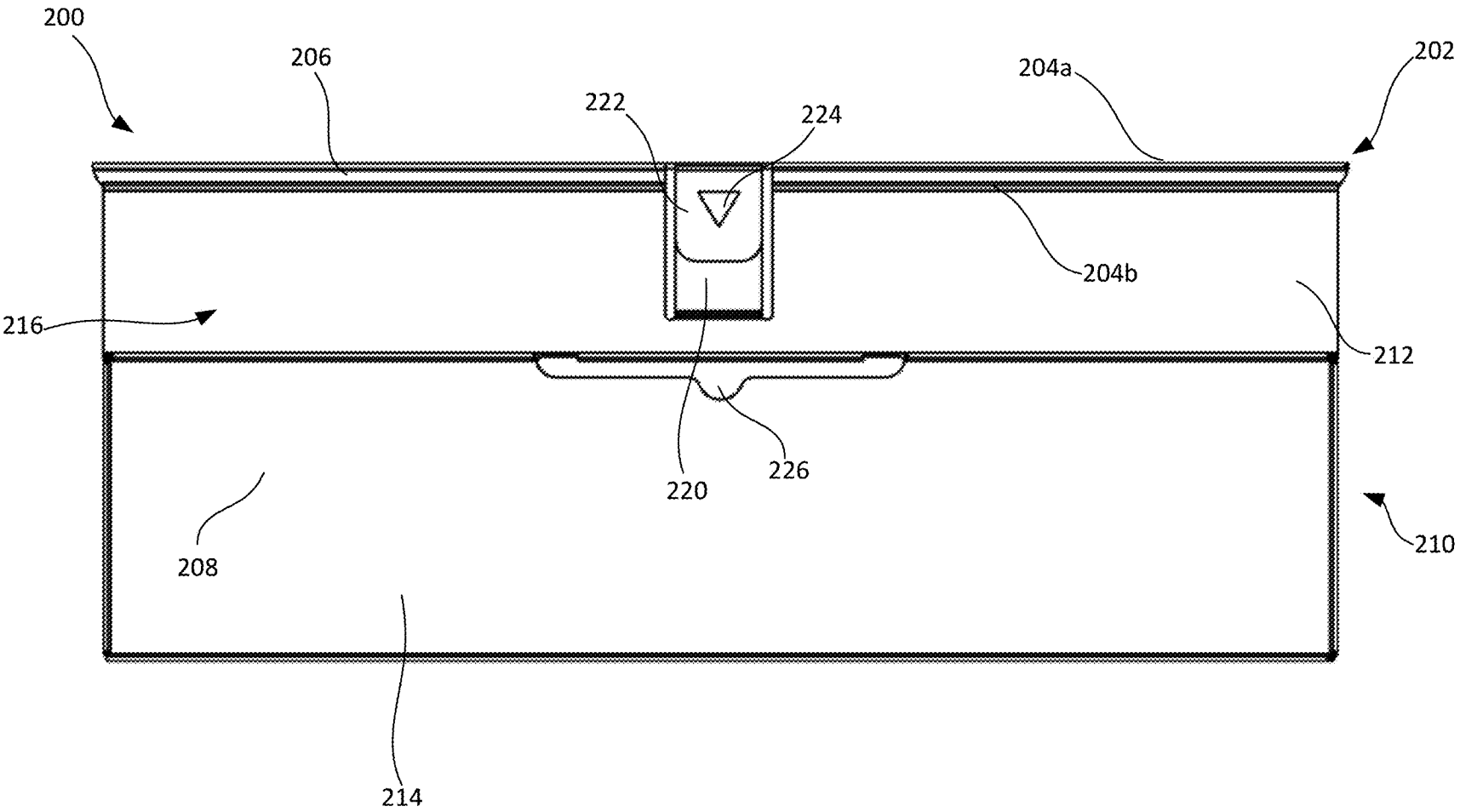
FIG. 2C is a top plan view of the peripheral insert of FIG. 2A.
Figure 2D:
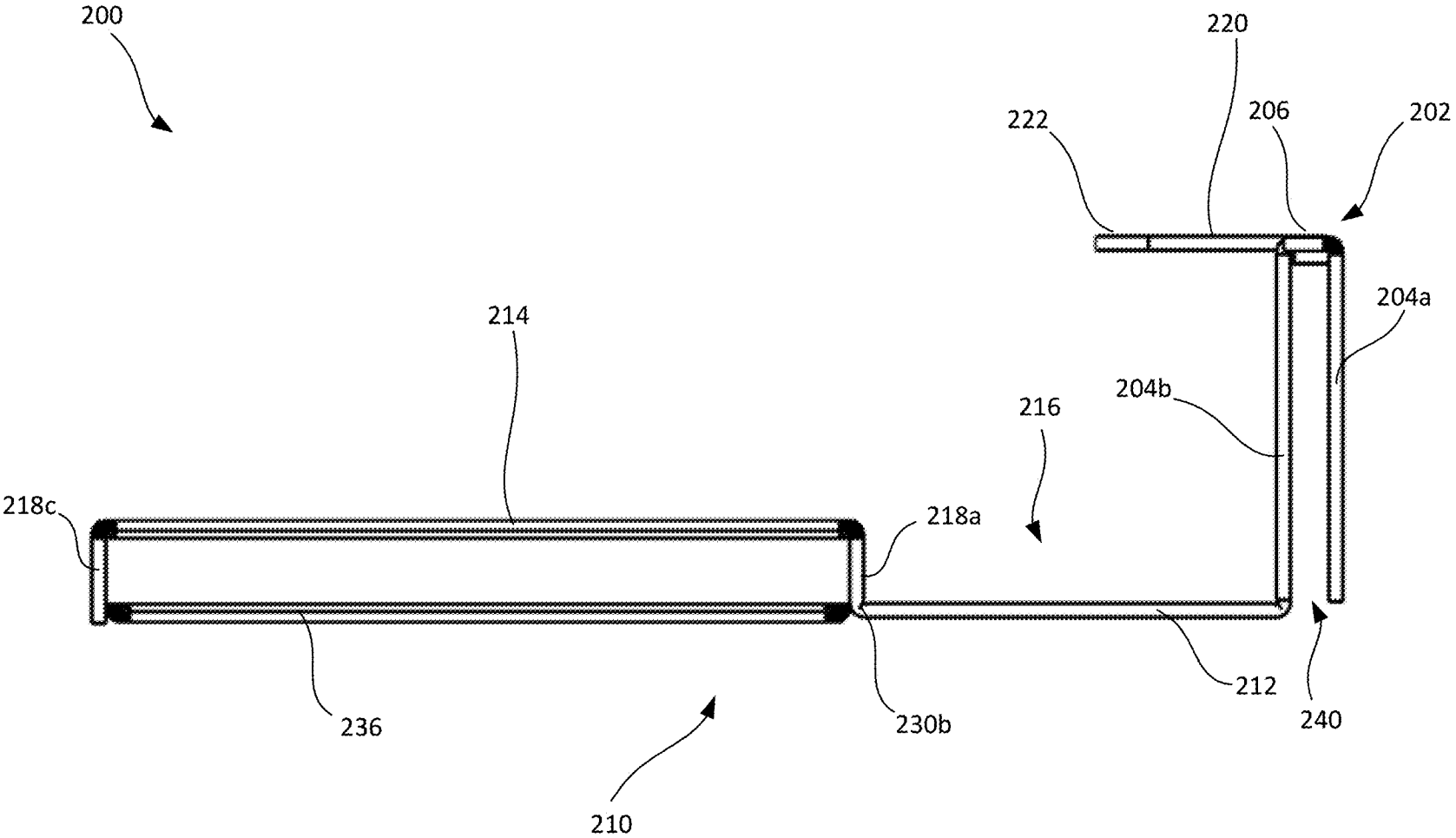
FIG. 2D is side elevation view of the peripheral insert of FIG. 2A in a stowed configuration according to embodiments of the present invention.

FIGS. 2A-2F illustrate a peripheral insert 200 in accordance with embodiments of the present invention. Peripheral insert 200 may be inserted within an interior cavity of an outer box, such as (but not limited to) outer box 100 described herein. The peripheral insert 200 may include a back portion 202 that may be coupled with a sidewall (such as rear sidewall 104*a*) of the outer box. For example, the back portion 202 may include two or more opposing walls 204 that are coupled with one another. As best illustrated in FIG. 2D, the back portion 202 includes two opposing walls 204 that are coupled with one another, such as by forming a number of creases within the material of the peripheral insert 200 to form two walls 204 that are at least substantially parallel to one another, with the material connecting the two walls 204 forming an upper surface 206 of the back portion 202. The walls 204 and upper surface 206 may define a generally U-shaped channel 240, which may receive a portion of a sidewall of an outer box. For example, the channel 240 may receive an inner layer (such as inner layer 108) of a sidewall of the outer box such that the upper surface 206 is disposed over a top edge of the inner layer. A rear wall 204*a* may be pinched between the inner layer and an outer layer (such as outer layer 110) of the outer box, which may help secure the peripheral insert 200 in place within the interior cavity of the outer box. In some embodiments, the back portion 202 may include one or more feature to secure the back portion 202 in place relative to the sidewall of the outer box. For example, the back portion 202 may define one or more connector tabs 208, slots, slits, and/or other features that may be used to secure the peripheral insert 200 with the sidewall of the outer box. The form of securing features provided on the peripheral insert 200 may be selected to be engageable with corresponding securing features provided on the outer box. For example, the outer box and peripheral insert 200 may include slot and connector tab connections, slit connections, and/or other connections. As illustrated in FIG. 2B, connector tabs 208 are defined in the rear wall 204*a* and are spaced apart from one another along a length of the rear wall 204*a*. While two connector tabs 208 are shown, it will be appreciated that any number of connector tabs 208 and/or other securing features may be formed in the rear wall 204*a*. For example, the rear wall 204*a* may define and/or include at least one securing feature, at least two securing features, at least three securing features, at least four securing features, at least five securing features, or more. The securing features may be formed at any height and/or lateral position about the rear wall 204*a*, and may correspond with locations of securing features (such as, but not limited to, slots 112) formed in the corresponding sidewall of the outer box. In some embodiments, rather than, or in addition to, using mechanical couplings to secure the rear wall 204*a* to the sidewall of the outer box, an adhesive may be applied between the rear wall 204*a* and the sidewall of the outer box to fixedly couple the components. While the rear wall 204*a* may be fixedly coupled with the sidewall of the outer box, a front wall 204*b* of the back portion 202 may be moveable relative to the rear wall 204*a* and/or the sidewall of the outer box, which may enable the peripheral insert 200 to move between a stowed configuration and an access configuration as will be discussed in greater detail below.

The peripheral insert 200 may include a base portion 210 that extends at an angle from a bottom edge of the back portion 202. In some embodiments, the base portion 210 may be at least substantially orthogonal to the back portion 210, although other angles are possible in various embodiments. The base portion 210 may extend in a forward direction from the back portion 202. The base portion 210 may include a rear section 212 and a front section 214 that are pivotally coupled with one another. For example, a crease may be formed between the two sections that enables the sections to pivot relative to one another. This may enable the rear section 212 and the front section 214 to be moveable between a stowed configuration (as shown in FIG. 2D) in which bottom surfaces of the rear section 212 and the front section 214 are at a first, larger angle $\alpha$ relative to one another and an access configuration (shown in FIG. 2E) in which bottom surfaces of the rear section 212 and the front section 214 are at a second, smaller angle R relative to one another. For example, in the access configuration, the rear section 212 and the front section 214 may be tented relative to one another, with upper surfaces of each of the rear section 212 and the front section 214 being angled upwards toward a center of the peripheral insert 200 and/or the interior cavity of the outer box. In some embodiments, angle $\alpha$ may be between about 160 degrees and 200 degrees, between about 165 degrees and 195 degrees, between about 170 degrees and 190 degrees, between about 175 degrees and 185 degrees, or about 180 degrees. In some embodiments, angle R may be between about 75 degrees and 145 degrees, between about 80 degrees and 140 degrees, between about 85 degrees and 135 degrees, between about 90 degrees and 130 degrees, between about 95 degrees and 125 degrees, between about 100 degrees and 120 degrees, between about 105 degrees and 115 degrees, or about 110 degrees.

In some embodiments, a width and/or length of the base portion 210 may be selected to substantially match corresponding dimensions of the interior cavity of the outer box such that one or more edges of the base portion 210 contact interior surfaces of one or more sidewalls of the outer box. This contact may result in friction between the peripheral insert 200 and the outer box that may maintain the peripheral insert 20 in a desired configuration (e.g., the stowed configuration or access configuration) until an outside force is applied to at least a portion of the peripheral insert 200 as will be described below in relation to FIGS. 3A and 3B.

In some embodiments, an upper surface of the rear section 212 is lower than an upper surface of the front section 214 such that a recess 216 is formed between the back portion 202 and the front section 214. In other words, the rear section 212 may form a bottom surface of the recess 216. The recess 216 may be provided when the peripheral insert 200 and outer box are used to package certain peripheral devices, such as keyboards. For example, a rear portion of the keyboard may have a greater thickness than a front portion of the keyboard, such as to accommodate batteries, feet, and/or other features. In such embodiments, the thicker portion of the peripheral device may be seated within the recess 216 atop the rear section 212, while the thinner front portion of the peripheral device may be seated atop the front section 214. This may enable a top surface of the peripheral device to be at least substantially parallel with the cover (such as cover 120) of the outer box, and may reduce size of open space within the closed outer box to help limit unwanted movement of the peripheral device within the outer box.

In some embodiments, the front section 214 may include one or more flaps 218 that extend at a downward angle from one or more peripheral edges of the front section 214. Oftentimes, the flaps 218 may be at least substantially orthogonal to an upper surface of the front section 214. Each flap 218 may have a height of between about 5 mm and 20 mm, between about 6 mm and 18 mm, between about 7 mm and 16 mm, between about 8 mm and 14 mm, or between about 10 mm and 12 mm. The height of each flap 218 may be selected to match a depth of the recess 216. Such a height may enable a bottom edge of each flap 218 to help support the front section 214 at the elevated height relative to the rear section 212 when a peripheral device is positioned atop the base portion 210 when the peripheral insert 200 is in the stowed configuration. In addition to supporting the front section 214 at the elevated height, the flaps 218 may increase the contact area (and subsequently the friction) between the peripheral insert 200 and the sidewalls of the outer box, which may help maintain the peripheral insert 200 in a desired configuration when no external force is applied to the peripheral insert 200.

The peripheral insert 200 may include a tab 220 that enables the peripheral insert 200 to be moved between the stowed configuration and the access configuration, such as by applying a pulling force on the tab 220. In some embodiments, the tab 220 may be defined by the back portion 202 and/or the base portion 210. For example, as illustrated in FIG. 2A, the back portion and the rear section 212 of the base portion 210 each define a portion of the tab 220. Such a design may ensure that when a pulling force is applied to the tab 220, the rear section 212 is pivoted upward relative to a bottom edge of the back portion 202. In some embodiments, the tab may extend through all or a portion of the front wall 204*b* and/or the rear wall 204*a* of the back portion 202. For example, as illustrated, the tab 220 extends through all of the front wall 204*b* and a portion of the rear wall 204*a*. By defining at least a portion of the tab 220 in both opposing walls 204 of the back portion 202, a distal end 222 of the tab 220 may protrude beyond a joint (e.g., upper surface 206) that couples the opposing walls 204. For example, a main body of the tab 220 may be folded and/or otherwise shaped to be substantially planer and/or parallel with the rear section 212 of the base portion 210 and with the back portion 202, while a distal end 222 of the tab 220 may extend laterally away from the back portion 202. The distal end 222 of the tab 220 may be folded toward a center of the peripheral insert 200 and/or the interior cavity of the outer box such that the distal end 222 of the tab 220 extends over a computer peripheral device disposed within the interior cavity of the outer box. Such positioning may ensure that the tab 220 is readily visible and graspable by a user accessing the computer peripheral device. The tab 220 may be positioned at any lateral location along the back portion 202, but is oftentimes centered on the back portion 202 to ensure that lifting of the tab 220 uniformly lifts the computer peripheral device disposed atop the peripheral insert 200. In some embodiments, the tab 220 may include one or more markings 224 that may indicate a direction to pull the tab 220 to move the peripheral insert 200 from the stowed configuration to the access configuration. For example, as illustrated, the marking 224 may include a triangle cutout that is pointed away from the back portion 202. In other embodiments, the marking 224 may be an arrow and/or other shape to indicate the direction of force. In some embodiments, the marking may be formed using printing, perforations, embossing, and/or stamping that define a shape that indicates a direction of the pulling force.

Figure 2E:
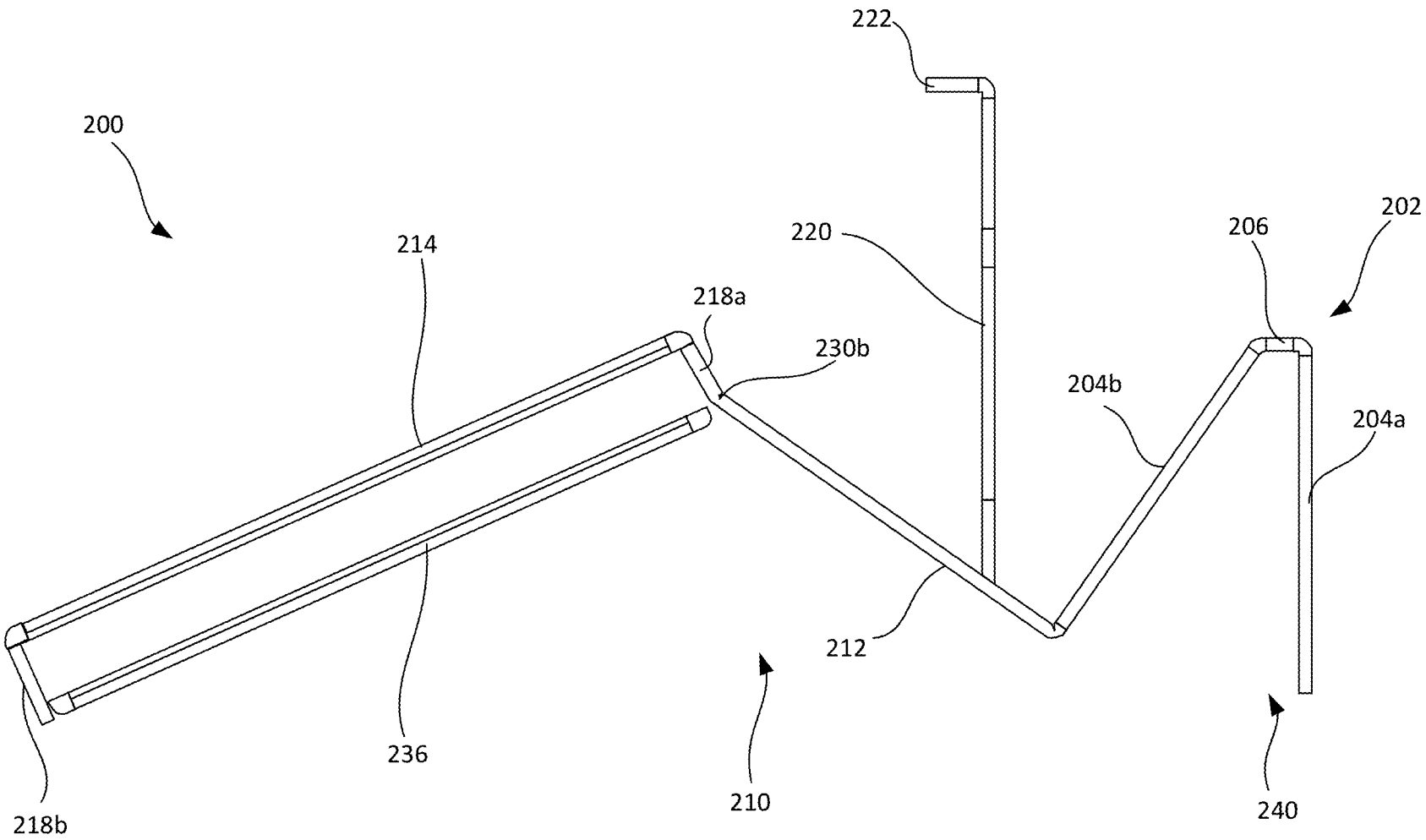
FIG. 2E is a side elevation view of the peripheral insert of FIG. 2A in an access configuration according to embodiments of the present invention.

Once the tab 220 has been pulled and the peripheral insert 200 is moved to the access configuration (as shown in FIG. 2E), the rear section 212 and the front section 214 of the base portion 210 of the peripheral insert 200 may be tented relative to one another. For example, when tented, the upper surfaces of each of the rear section 212 and the front section 214 may be angled upwards toward a center of the peripheral insert 200. As the tab 220 is pulled the front wall 204*b* of the back portion 202 may be pulled away from the rear wall 204*a*, which may force the rear section 212 in a direction of the front section 214. The movement of the rear section 212 may cause the base portion 210 to bend, which may force inner edges of the rear section 212 and front section 214 to elevate (e.g., tent), while outer edges of the rear section 212 and front section may remain substantially in place.

In some embodiments, the peripheral insert 200 may define one or more features that provide additional storage locations. As just one example, the peripheral insert 200 may define one or more slits 226 that may be sized and shaped to receive one or more items, such as (but not limited to) a user manual, a power cable, a warranty card, and/or other object. As illustrated, the slit 226 extends through an upper and a rear lateral surface (such as a rear flap 218*a* proximate rear section 212) of the front section 214, which enables the slit 226 to be moved upward when the peripheral insert 200 is moved to the access configuration. For example, as the front section and rear section 212 tent relative to one another, the slit 226 may be projected upward to present the object to the user upon the computer peripheral device being removed from the peripheral insert 200. In other words, when the peripheral insert 200 is in the access configuration the user manual or other object may be angled upward relative to the bottom surface of the outer box at a greater angle than when the peripheral insert 200 is in the stowed configuration. It will be appreciated that the slit 226 may be disposed at any location (lateral or front to back) on the peripheral insert 200, and is not limited to being disposed on the front section 214. In some embodiments, an opening or aperture forming the slit 226 may have a constant width, while in other embodiments the aperture may include one or more areas with an increased width. These larger areas may improve the ease with which a user may retrieve items positioned within the slit 226.

Figure 2F:
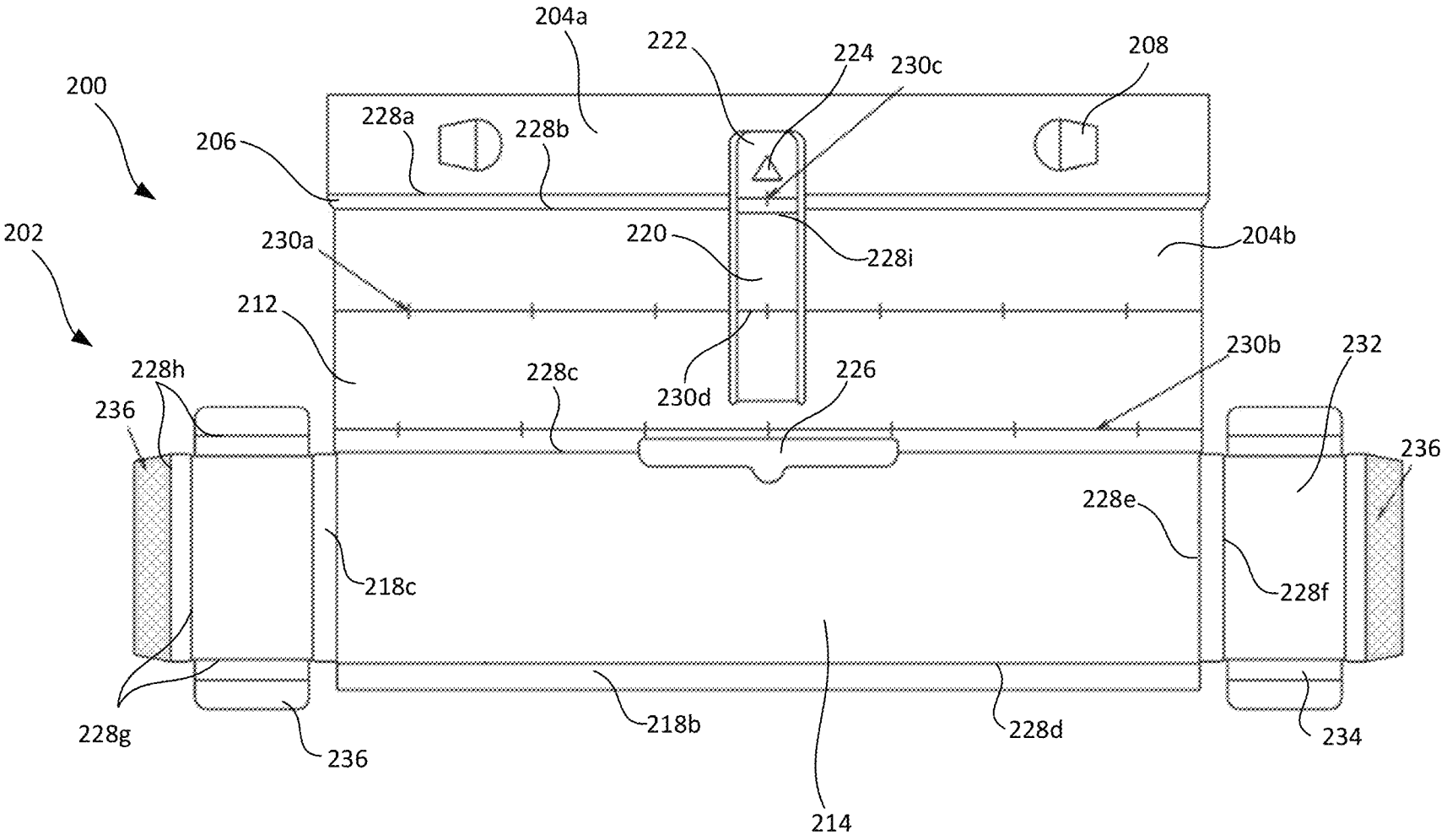
FIG. 2F is a top plan view of the peripheral insert of FIG. 2A in an unfolded state according to embodiments of the present invention.

As noted above, the peripheral insert 200 may be formed from a single piece of a sustainable material (such as, but not limited to, cardboard) in some embodiments. For example, the peripheral insert 200 may be cut, stamped, and/or otherwise formed from a single piece of sheet material that may be folded to form the final peripheral insert 200. FIG. 2F illustrates the peripheral insert 200 in a flat, unfolded state that may demonstrate how the peripheral insert 200 may be formed from a single piece of material. For example, the back portion 202 and base portion 210 (including rear section 212, front section 214, and flaps 218) may be formed from a single piece of material, with each section being separated by one or more creases 228 (which bend toward the figure as illustrated) and/or reverse creases 230 (which bend away from the figure as illustrated).

As illustrated, the rear wall 204*a* and front wall 204*b* of the rear portion 202 are separated by creases 228*a* and 228*b*. When folded such that the rear wall 204*a* and the front wall 204*b* are at least substantially parallel, U-shaped channel 240 is formed between the walls 204. The area between creases 228*a* and 228*b* forms upper surface 206 of the back portion 202. Reverse crease 230*a* is disposed at a bottom edge of the front wall 204*b* and marks a rearmost boundary of the rear section 212 of the base portion 210. Reverse crease 230*b* marks a forwardmost boundary of the rear section 212. The area between reverse crease 230*b* and crease 228*c* forms a generally vertical surface (e.g., a rear flap 218*a*) that defines a relative height difference between the front section 214 and rear section 212, and thereby defines a depth of recess 216. A length of the upper surface of front section 214 is defined by crease 228*c* and crease 228*d*. Material extending forward of crease 228*d* may form a front flap 218*b* of the peripheral insert 200. Creases 228*e* may define lateral boundaries of the upper surface of front section 214. The areas between creases 228*e* and 228*f* on each side of the front section 214 may form lateral flaps 218*c*.

In some embodiments, the peripheral insert 200 may include reinforcement flaps 232 that may be folded under the front section 214 to help support the front section 214 at an elevated height relative to the rear section 212 when a peripheral device is positioned atop the base portion 210. For example, a number of creases 228*g* and 228*h* on each reinforcement flap 232 may form boundaries of vertical sections 234, with securing flaps 236 being disposed beyond some or all of the creases 228*h*. The securing flaps 236 may be folded up underneath the front section 214 and may form a portion of a platform that bears the weight of the peripheral device to maintain the front section 214 at the elevated height. One or more of the securing flaps 236 may include an adhesive in some embodiments, which may enable the securing flap 236 to be adhesively secured to a bottom surface of the front section 214. For example, as illustrated a lateral-most securing flap 236 on either side of the front section 214 may include an adhesive.

The tab 220 may be cut into the material, such as by cutting and/or otherwise forming a generally U-shaped slit in the material to separate the tab 220 from the rest of the material. As noted above, the tab 220 may be formed as part of the rear section 212 of the base portion 210, the front wall 204*b* of the back portion 202, and/or the rear wall 204*a* of the back portion 202. The tab 220 may include a reverse crease 230*c* that is aligned with reverse crease 230*b* and a crease 228*i* that is substantially aligned with crease 228*b*. When folded, reverse crease 230*c* and crease 228*i* enable the tab 220 to be substantially aligned with the rear section 212 and the back portion 202 so as to prevent the tab 220 from taking up additional space within the open interior of an outer box. A reverse crease 230*d* may be provided at a base of the distal end 222 of the tab that enables the distal end 222 to be folded toward a center of the peripheral insert 200 and to extend over at least a portion of a top surface of the peripheral device seated atop the peripheral insert 200. In some embodiments, the slit 226 may be cut into the material, such as by forming an aperture in the front section 214 and/or the rear flap 218*a*. Once folded, the aperture may form a three dimensional slit 226 that may be sized and shaped to 108 receive one or more objects in both the stowed configuration and the access configuration. In some embodiments, connector tabs 208, slots, slits, and/or other securing features may be formed into the rear wall 204*a* of the back portion 202. By folding the material in the proper direction at each crease 228 and reverse crease 230, the peripheral insert 200 may be assembled into the form illustrated in FIGS. 2A-2E.

While described as being formed from a single material, it will be appreciated that in some embodiments additional materials may be used to form a portion of the peripheral insert 200. As just one example, the tab may be a separate component which may be formed from the same or a different material as the rest of the peripheral insert. In such embodiments, the tab may be adhered and/or otherwise fastened to the rear section of the peripheral insert to enable the tab to be used to transition the peripheral insert between the stowed configuration and the access configuration.

Figure 3A:
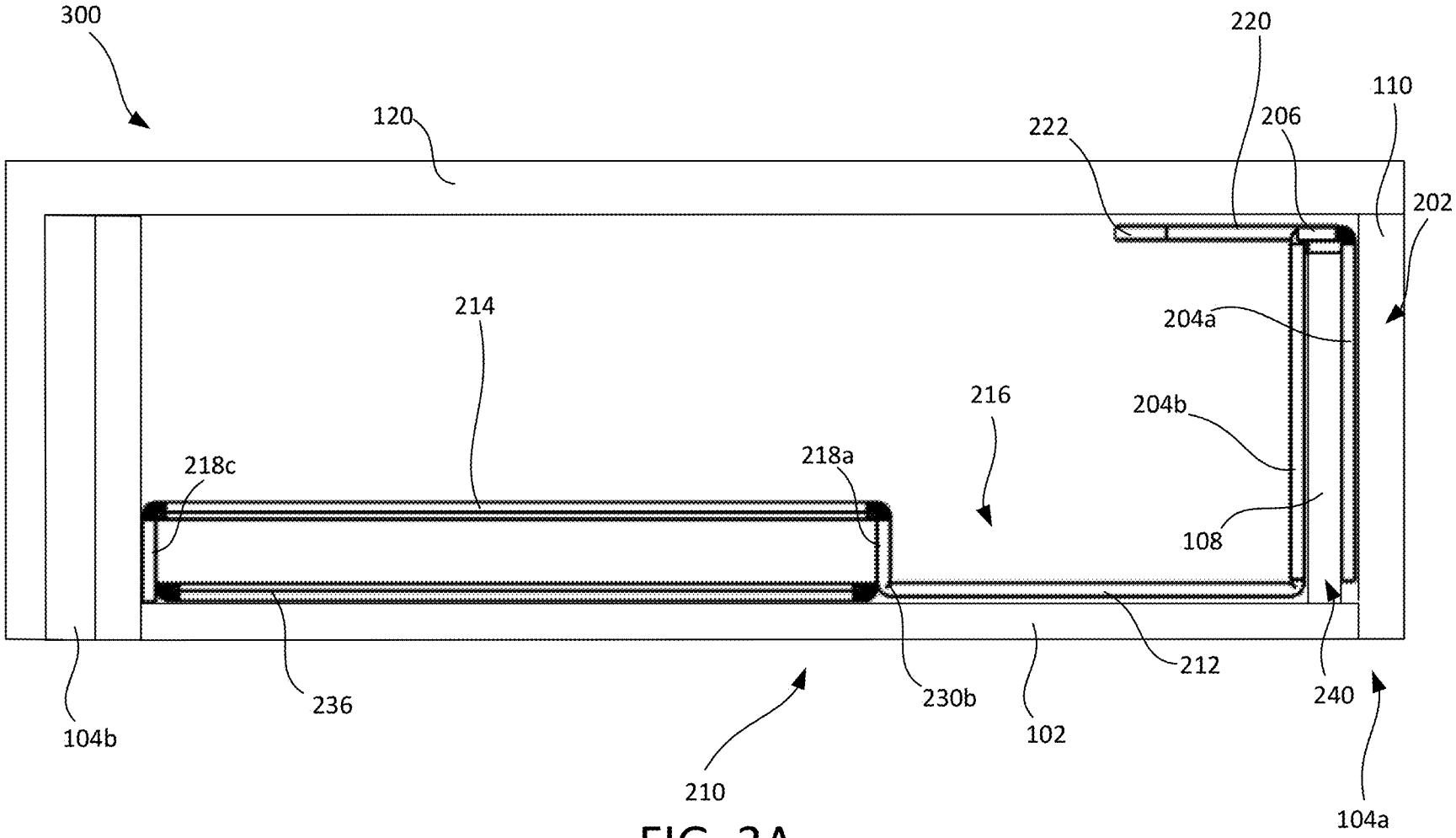
FIG. 3A is a side elevation view of a computer peripheral device package in a stowed confirmation according to embodiments of the present invention.
Figure 3B:
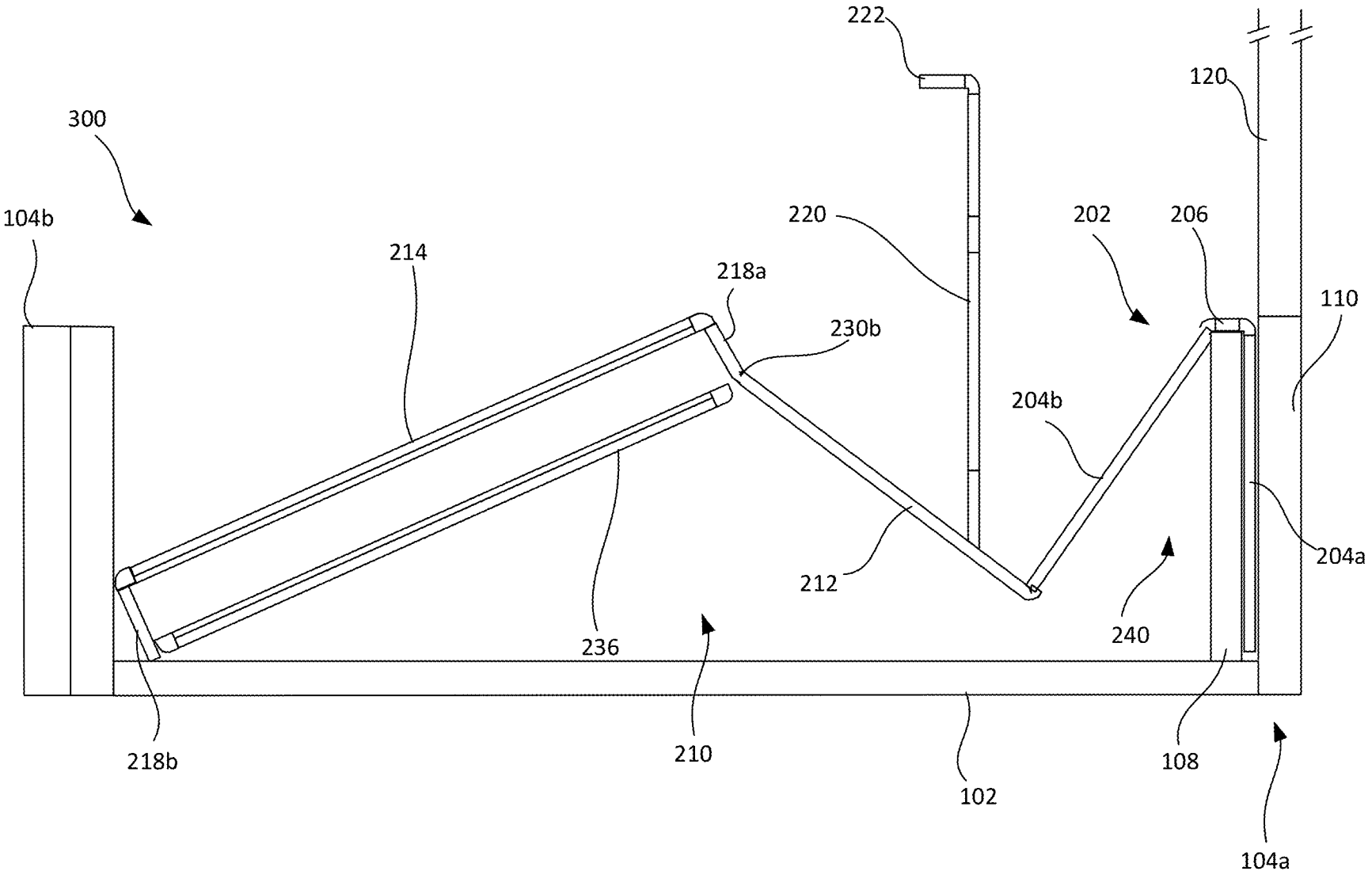
FIG. 3B is a side elevation view of the computer peripheral device package of FIG. 3A in an access confirmation according to embodiments of the present invention.

FIGS. 3A and 3B illustrate cross-sectional side elevation views of one embodiment of a product package 300 that may be used to package a computer peripheral device. The package may include outer box 100 (or any other outer box that defines an interior cavity). Peripheral insert 200 may be positioned within the interior cavity 106 of the outer box 100, with the inner layer 108 of the rear sidewall 104*a* being received within the U-shaped channel 240 formed between the rear wall 204*a* and front wall 204*b* of back portion 202 of the peripheral insert 200. In embodiments in which the inner layer 108 and rear wall 204*a* include securing features, the corresponding securing features of each component may be engaged to fixedly couple the inner layer 108 and rear wall 204*a*. The peripheral insert 200 may be sized such that at least some lateral edges of the peripheral insert 200 (such as edges of the back portion 202 and/or base portion 210) contact the interior surfaces of one or more sidewalls 104 of the outer box 100. This contact may generate friction between the peripheral insert 200 and the outer box to maintain the peripheral insert 200 in a desired configuration until an outside force is applied to at least a portion of the peripheral insert 200.

As noted above, the peripheral insert 200 may be maneuvered between a stowed configuration and an access configuration. FIG. 3A illustrates the peripheral device 200 in the stowed configuration within the outer box 100. In the stowed configuration, the base portion 210 (including the rear section 212 and/or front section 214) of the peripheral insert 200 may be seated against the bottom surface 102 of the outer box 100. For example, a bottom surface of the rear section 212 of the peripheral insert 200 may be seated atop the bottom surface 102 of the outer box 100, while the reinforcement flaps 232 and/or bottom edges of flaps 218 of the front section 214 may be seated atop the bottom surface 102 to maintain the front section 214 at an elevated position relative to the rear section 212. In some embodiments, upper surfaces of the rear section 212 and/or front section 214 may be at least substantially parallel with the bottom surface 102 of the outer box 100, although other angles are possible in various embodiments. When in the stowed configuration, the back portion 202 of the peripheral insert 200 may be substantially parallel to the rear sidewall 104*a* of the outer box 100. For example, both the rear wall 204*a* and front wall 204*b* may be positioned against and/or otherwise at least substantially parallel to the rear sidewall 104*a*.

The package 300 may be received by a user in the stowed configuration, such as with cover 120 positioned over the interior cavity 106. The cover 120 may be removed to expose the peripheral device within the interior cavity 106. The distal end 222 of the tab 220 may extend over a top surface of the peripheral device. The user may apply a force, such as a pulling force on the distal end 222 of the tab 220 to transition the package 300 from the stowed configuration to the access configuration shown in FIG. 3B. For example, in some embodiments the user may apply a pulling force in a direction indicated by the one or more markings 224 provided on the distal end 222 of the tab 220. In the access configuration, the rear section 212 and the front section 214 of the base portion 210 of the peripheral insert 200 may be tented relative to one another. For example, when tented, the upper surfaces of each of the rear section 212 and the front section 214 may be angled upwards toward a center of the peripheral insert 200 and/or the interior cavity 106 of the outer box 100. At least some of the back portion 202 of the peripheral insert 200 may be pulled away from and angled relative to the rear sidewall 104*a* of the outer box 100. For example, as the tab 220 is pulled the front wall 204*b* of the back portion 202 may be pulled away from inner layer 108 and/or the rear wall 204*a*, which may force the rear section 212 in a direction of the front section 214. The movement of the rear section 212 may cause the base portion 210 to bend at reverse crease 230*b*, which may force inner edges (i.e., edges closest to reverse crease 230*b*) of the rear section 212 and front section 214 to elevate (e.g., tent) relative to the bottom surface 102 of the outer box 100, while outer edges (i.e., edges furthest from reverse crease 230*b*) of the rear section 212 and front section 214 may remain in contact with or otherwise proximate the bottom surface 102. When the front section 214 and rear section 212 are tented, the inner edges of the rear section 212 and front section 214 may project vertically, and in some embodiments may be at a height that is proximate and possibly above a top edge of the sidewalls 104 of the outer box 100 to lift or otherwise elevate the computer peripheral device disposed within the interior cavity 106 to be elevated within the interior cavity 106 such that at least a portion of the computer peripheral device extends above a top edge of the sidewalls 104 to better enable the user to grasp the peripheral device.

In some embodiments, the package 300 may be reused, such as to store the peripheral device when not in use (e.g., in storage), during transit, and/or other purpose. To reuse the package, the peripheral insert 200 may be transitioned from the access configuration to the stowed configuration to enable the cover 120 to be re-engaged with the rest of the outer box 100. In some embodiments, transitioning the peripheral insert 200 to the stowed configuration may be achieved by applying a downward force to the inner edges (e.g., the tented portion) of the front section 214 and rear section 212. The downward force may press the inner edges downward and may force the rear edge of the rear section 212 toward the rear wall 104*a* of the outer box 100. This, in turn, may cause the front wall 204*b* of the rear portion 210 of the peripheral insert 200 to move rearward toward (and possibly against) the inner layer 108 of the rear sidewall 104*a* to return the peripheral insert 200 to the stowed configuration illustrated in FIG. 3A.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or +0.1% from the specified value, as such variations are appropriate to in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or +0.1% from the specified value, as such variations are appropriate to in the context of the systems, devices, circuits, methods, and other implementations described herein.

Where a range of values is provided, it is understood that each intervening value, to the smallest fraction of the unit of the lower limit, unless the context clearly dictates otherwise, between the upper and lower limits of that range is also specifically disclosed. Any narrower range between any stated values or unstated intervening values in a stated range and any other stated or intervening value in that stated range is encompassed. The upper and lower limits of those smaller ranges may independently be included or excluded in the range, and each range where either, neither, or both limits are included in the smaller ranges is also encompassed within the technology, subject to any specifically excluded limit in the stated range. Where the stated range includes one or both of the limits, ranges excluding either or both of those included limits are also included.

As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

What is claimed is:

1. A package for a computer peripheral device, comprising:

an outer box comprising a bottom surface and a plurality of sidewalls that define an interior cavity; and a peripheral insert that is positionable within the interior cavity, the peripheral insert comprising:

a back portion that is coupled with a rear sidewall of the plurality of sidewalls of the outer box;

a base portion that extends at an angle from a bottom edge of the back portion, wherein:

the base portion comprises a rear section and a front section that are pivotally coupled with one another;

the back portion and the rear section of the base portion define a tab;

the peripheral insert is movable between a stowed configuration and an access configuration by applying a pulling force on the tab;

in the stowed configuration, the base portion of the peripheral insert is seated against the bottom surface of the outer box and the back portion of the peripheral insert is substantially parallel to the rear sidewall of the outer box;

in the access configuration, the rear section and the front section of the base portion are tented relative to one another and at least a part of the back portion of the peripheral insert is pulled away from and angled relative to the rear sidewall of the outer box; and at least a portion of the back portion is secured with the rear sidewall of the outer box using one or more coupling features, wherein the one or more coupling features comprise a slot formed in one of the back portion and the rear sidewall and a corresponding connector tab formed in the other one of the back portion and the rear sidewall, the connector tab being engageable within the slot to secure the back portion with the rear sidewall of the outer box.

2. The package for a computer peripheral device of claim 1, wherein:

an upper surface of the rear section is lower than an upper surface of the front section such that a recess is formed between the back portion and the front section.

3. The package for a computer peripheral device of claim 1, wherein:

the back portion comprises two opposing walls that are coupled with one another and that extend over a portion of the rear sidewall of the outer box.

4. The package for a computer peripheral device of claim 3, wherein:

the tab is defined in both opposing walls such that when the back portion of the peripheral insert is positioned over the portion of the rear sidewall of the outer box, a distal end of the tab protrudes beyond a joint coupling the opposing walls.

5. The package for a computer peripheral device of claim 1, wherein:

the front section of the base portion comprises flaps that extend at angle from peripheral edges of the front section.

6. The package for a computer peripheral device of claim 1, wherein:

one of the plurality of sidewalls of the outer box defines a recess that is sized and shaped to receive a connection mechanism of a peripheral device.

7. The package for a computer peripheral device of claim 1, wherein:

when the rear section and the front section of the base portion are tented relative to one another, upper surfaces of each of the rear section and the front section are angled upwards toward a center of the interior cavity.

8. The package for a computer peripheral device of claim 6, wherein:

the front section of the base portion defines a slit that is sized to receive a user manual such that when the peripheral insert is in the access configuration the user manual is angled upward relative to the bottom surface of the outer box at a greater angle than when the peripheral insert is in the stowed configuration.

9. The package for a computer peripheral device of claim 6, wherein:

in the access configuration at least a part of the back portion of the peripheral insert is pulled away from and angled relative to the rear sidewall of the outer box.

10. A package insert for a computer peripheral device, comprising:

a back portion having at least one wall;

a base portion coupled to a bottom edge of the back portion, extending at an angle relative to the back portion, wherein:

the base portion comprises a rear section and a front section that are pivotally coupled with one another;

the rear section and the front section are moveable between a stowed configuration in which bottom surfaces of the rear section and the front section are at a first angle relative to one another and an access configuration in which bottom surfaces of the rear section and the front section are at a second angle relative to one another;

the first angle is different than the second angle;

the back portion and the rear section of the base portion define a tab; and the back portion defines one or both of a slot and a connector tab.

11. The package insert for a computer peripheral device of claim 10, wherein:

in the access configuration, the rear section and the front section are tented relative to one another.

12. The package insert for a computer peripheral device of claim 10, wherein:

a distal end of the tab extends laterally away from the back portion.

* * * * *